United States Patent [19]

DeFonzo

[11] 4,282,499

[45] Aug. 4, 1981

[54] OPTICALLY TUNABLE RESONANT STRUCTURE

[75] Inventor: Alfred P. DeFonzo, Alexandria, Va.

[73] Assignee: The United States of America as represented by the Secretary of the Navy, Washington, D.C.

[21] Appl. No.: 78,266

[22] Filed: Sep. 24, 1979

[51] Int. Cl.[3] ..... H01P 7/00

[52] U.S. Cl. ..... 333/231; 333/235; 357/30

[58] Field of Search ..... 333/99 PL, 219, 211, 333/235, 231; 331/66, 96; 357/30; 350/96.12

[56] References Cited

U.S. PATENT DOCUMENTS

| | | | |
|---|---|---|---|
| 3,040,262 | 6/1962 | Pearson | 357/30 X |
| 3,397,316 | 8/1968 | Brown et al. | 357/30 X |
| 3,818,370 | 6/1974 | Abe et al. | 357/30 X |

*Primary Examiner*—Paul L. Gensler

*Attorney, Agent, or Firm*—R. S. Sciascia; William T. Ellis; Vincent J. Ranucci

[57] ABSTRACT

A resonant structure, for supporting electromagnetic (EM) oscillations within a frequency range of approximately 10 GHz to 1000 GHz, and whose resonant properties are controlled by light. The structure includes an interaction material for absorbing light and forming a plasma of electron-hole pairs within the material. Kinetic and potential energy, which are stored in the EM oscillations within the resonant structure, change as a result of the plasma and shift the frequency of the oscillations.

23 Claims, 3 Drawing Figures

OPTICALLY TUNABLE RESONANT STRUCTURE

BACKGROUND OF THE INVENTION

This invention relates to tunable resonant structures and especially to an optically tunable resonant structure which can support electromagnetic (EM) oscillations within a frequency range of about 10 GHz to 1000 GHz.

Conventionally tunable resonant devices are used in many applications, such as directional filters, channel-dropping filters, directional couplers, and traveling-wave modulators. Such resonant devices are mechanically or electrically tunable. For example, mechanical tuning includes the insertion of a flat dielectric material into a ring resonator, and a series of slits across a circular resonator. Electrical tuning features the application of an electrical control signal to a resonant structure.

Conventional electrically tunable resonators use ferrite, diodes or PIN semiconductor devices as an interaction material to induce a change in the frequency of EM oscillations.

The operation of the ferrite resonator is dependent upon the interaction between a slab of ferrite material and a magnetic biasing field for its frequency-changing effect. Ferrite materials cause a relatively high attenuation of EM energy at millimeter wavelengths.

The diode resonators employ one or more diodes mounted inside a resonant structure. The diodes are responsive to a D.C. bias voltage applied across the diode electrodes. The field produced by the bias voltage induces a change in the electrical characteristics of the diode which, in turn, affects the impedance at various points within the resonant structure. The change in impedance causes a change in the resonant frequency of the resonator. At frequencies above about 60 GHz, the internal dimensions of the resonator are relatively small so that accurate positioning of a diode is a problem. Also, the attenuation of EM oscillations by a variable reactance diode increases with increasing frequency above approximately 60 GHz.

A PIN semiconductor resonator is a slab of variable-conductivity semiconductor material in contact with a portion of the surface area of one of the walls of the resonator. The microwave conductivity of the semiconductive slab is responsive to the polarity of a D.C. bias voltage applied across the slab electrodes. The polarity of the applied bias voltage changes the conductivity of the slab and causes the resonant properties of the slab to change.

These conventional resonant structures require the application of an electrical signal by either inductive coupling, such as by coils, to the ferrite, or by wiring to the diode or PIN semiconductor. Such applications require structures and circuitry, some of which must be attached to the interaction material and which may cause spurious interference and insertion loss to the frequency-changing performance. The circuitry typically includes isolation networks to prevent such interference. The structures and circuitry are costly and may be inconvenient for specific applications where space is limited.

The response time, that is, the time for the EM oscillation to shift in frequency in response to the electrical signal applied to the resonator, is slow for conventional resonators because the response time is dependent on the medium which conducts the electrical signal. The response time for the PIN semiconductor resonators is further dependent on the traversal of electron-hole pairs across its entire intrinsic region.

SUMMARY OF THE INVENTION

The general purpose and object of the present invention is to optically tune a resonant structure, that is, more precisely, to optically control changes in frequency of electromagnetic (EM) oscillations within a resonant structure in the frequency range of 10 GHz to 1000 GHz.

This and other objects of the present invention are accomplished by a resonator comprising an interaction material which absorbs light and forms a plasma of electron-hole pairs within that portion of the material upon which the light strikes. The plasma alters the relationship between the kinetic and potential energy stored in the EM oscillation field by changing the reactive and resistive properties of the resonator.

The present invention is advantageous because the control signal applied to the resonator is optical and not electrical. A medium such as air conducts the optical control signal and, therefore, no electrical structures, circuitry or isolation networks must be attached to the interaction material. The oscillating EM field interacts with only the electron-hole pairs and not with the light. Thus, the isolation between the source of the optical signal and the resonator is nearly infinite so that interferences and insertion losses are very low. Another advantage is that any attenuation losses are minimized. Also, the amount of interaction material required for changing the frequency may be small compared to the size of the resonator. The low insertion losses and compactness of the present invention are particularly applicable to frequencies in the range of 60 GHz to 600 GHz.

The response time of the optically-tunable resonator is much faster than that of conventional resonators because the optical control signal operates at a higher EM frequency than the resonant frequency of the resonator. Optical injection of electron-hole pairs occurs simultaneously over the illuminated portion of the interaction material. Thus, the only factor which limits the response time of the optically-tunable resonator is the response time of the resonator. A faster response time enables more information to be processed by the system which utilizes the present invention.

The optically-tunable resonator is economical, compact, efficient and convenient compared to conventionally-tunable resonators.

DETAILED DESCRIPTION OF THE INVENTION

Figure 1:
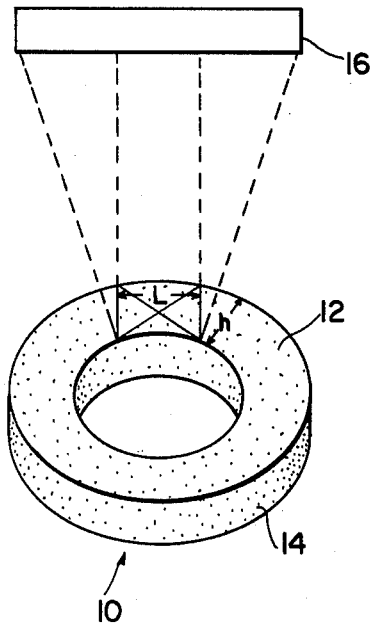
FIGS. 1–3 are isometric illustrations of three embodiments of the present invention.
Figure 2:
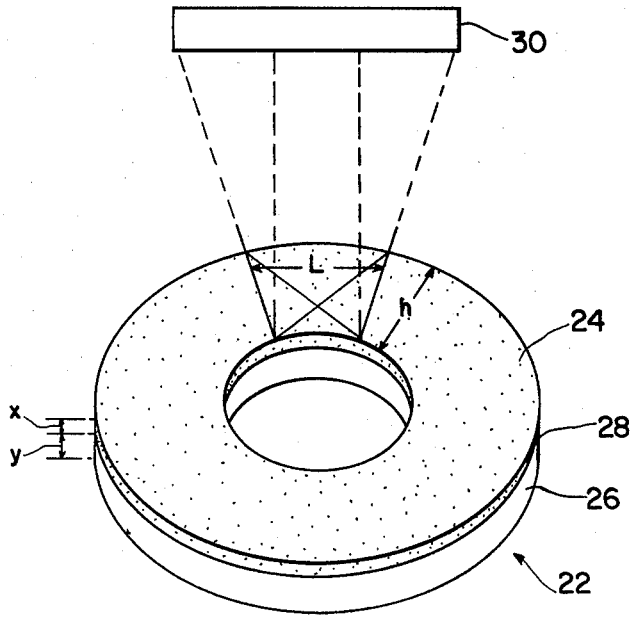
Figure 3:
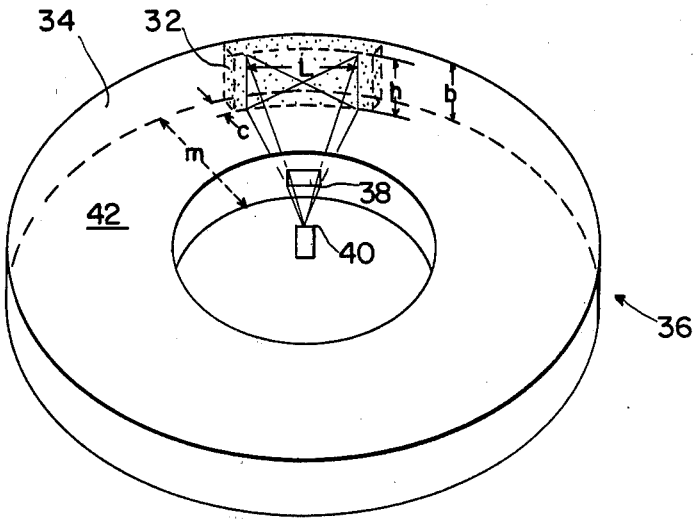

Referring now to the drawing, wherein like reference characters designate like or corresponding parts throughout the several views, FIG. 1 shows an optically tunable resonant structure 10, also referred to hereinafter as a resonator, having an annular shape and preferably having broad and narrow wall dimensions, 12 and 14 respectively. The resonator 10 is formed from a solid dielectric interaction material which will be more fully described hereinafter. A source 16 of light illuminates preferably a broad-dimensioned wall 12 of the resonator 10. The resonator 10 of FIG. 1 and also the resonators shown in FIGS. 2 and 3 are in the form of a ring with a rectangular cross-section for illustrative purposes. However, the resonators may be in the form of any structure having resonant properties.

FIG. 2 illustrates a second embodiment of the present invention which includes a resonant structure 22, preferably having broad and narrow wall dimensions, 24 and 26 respectively, and having a film 28 of interaction material on the external side of preferably a broad-dimensioned wall of the structure. A source of light 30 illuminates the film 28. In this embodiment the resonant structure 22 is fabricated from a dielectric material which is different from the interaction material of the film 28. However, the permittivity of the dielectric resonant structure 22 must be approximately the same as the permittivity of the film 28. The thickness x of the film 28 is small in comparison to the thickness y of the resonant structure 22, that is $x \lesssim y/10$, and may be adjusted for optimum performance.

FIG. 3 shows a third embodiment of the present invention which includes a slab 32 of interaction material attached to the internal side of preferably a narrow-dimensioned wall, and more preferably to the internal wall 34 of larger circumference, of a metal resonant structure 36. The slab 32 of interaction material may be placed anywhere within the resonant structure 36 but optimum performance requires the slab to be located on the internal side of the narrow-dimensioned wall 34 having the larger circumference. A wall of the resonant structure 36 includes window 38 through which light from a light source 40 passes and strikes the slab 32. The height h of the slab 32 is preferably the same as the height b of the internal narrow-dimensioned wall 34 of the resonant structure 36. The thickness c of the slab 32 is small in comparison to the width m of the broad-dimensioned wall 42 of the resonant structure 36, that is, $c \lesssim m/10$, and may be adjusted for optimum performance.

In all three embodiments the interaction material must absorb the light from the source and thereby form a plasma of electron-hole pairs which decreases the resistivity of the material. A preferred material is high-resistivity, (that is, approximately equal to or greater than 10 ohm-centimeters) semiconductor material, preferably covalently bonded, semiconductor material, such as silicon or germanium. The source of light may be any type, such as an injection laser, that produces light having a wavelength approximately equal to or slightly more than the optical absorption edge, that is, the wavelength at which light begins to be significantly absorbed, of the interaction material. The greater the wavelength of the light in comparison to the absorption edge of the material, the less the penetration of light through the material. Any conventional medium such as air, vacuum, lens, fiber bundle, or optical waveguide, may be used to transmit light from the source to the material.

The portion $A = L \times h$ of interaction material illuminated by the light is adjustable in all three embodiments, as further explained hereinafter.

As a semiconductor material is illuminated, a plasma forms in the illuminated region of the semiconductor. As the density of the plasma increases, the resistivity of the semiconductor material decreases. The resistivity of the semiconductor decreases to levels which cause absorption and attenuation of microwaves, and thus a change in amplitude of the microwaves. However, as the plasma density continues to increase, the resistivity of the semiconductor further decreases and reaches a level which does not cause absorption, attenuation, and change of amplitude of microwaves, but rather, does cause a change in the reactance of the resonant cavity for shifting the frequency of EM oscillations. Thus the plasma density is increased so that the resistivity of the semiconductor decreases to a point where the plasma excludes the EM field from the volume that the plasma occupies. The plasma density may be adjusted to achieve such frequency shifting by controlling the volume of the plasma and the amount of the plasma within a volume. Such control includes regulating the penetration depth of the light (the wavelength of light with respect to the optical absorption edge of the semiconductor material), the intensity of the light, and/or the dimensions of semiconductor material with respect to the dimensions of the resonant structure.

In the first embodiment shown in FIG. 1, the light penetrates about ten percent or less of the material for maximum efficiency. The penetration depth of the light can be adjusted by selectively matching the wavelength of the light to the optical absorption edge of the material, as previously explained. In the second and third embodiments, shown in FIGS. 2 and 3 respectively, the light penetrates the entire depth of the material for optimum tuning performance.

In operation, an electromagnetic oscillation in the resonant structure has an angular frequency $\omega$. Light from some source strikes an adjustable area (which is determined by L and h in FIGS. 1–3) of the interaction material and forms a plasma of electron-hole pairs in that portion of the material. This optical formation of the electron-hole plasma alters the effective dielectric response $\epsilon$ of the medium, comprising the resonant structure, that sustains the electromagnetic oscillations. The change in dielectric response $\Delta\epsilon$ causes a change in the frequency $\Delta\omega$ of oscillation for optically tuning the resonant structure. The relationship between the relative change in the frequency $(\Delta\omega/\omega)$ of the electromagnetic oscillations sustained by the resonator and the relative change in the effective dielectric response $(\Delta\epsilon/\epsilon)$ is approximately:

$$\Delta\omega/\omega \approx c\ \Delta\epsilon/\epsilon,$$

where c is a constant of proportionality.

Obviously many more modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A resonator, for supporting electromagnetic oscillations within the frequency range of approximately 10 GHz to 1000 GHz, having resonant properties which are controllable by light from a source of light comprising:

a resonant structure having an interaction material having an optical absorption edge not greater than the wavelength of said light, said material being of a type which forms a plasma of electron-hole pairs when illuminated by said source of light, said plasma having sufficient density to change the reactance and dielectric response of said resonant structure thereby shifting the frequency of said electromagnetic oscillations.

2. A resonator as recited in claim 1, wherein said resonant structure is annular.

3. A resonator as recited in claim 2, wherein said resonant structure includes walls of broad and narrow dimensions.

4. A resonator as recited in claim 2, wherein said resonant structure consists essentially of said interaction material.

5. A resonator as recited in claim 3, wherein said broad-dimensioned wall is an external wall and said resonant structure includes a film of said interaction material attached to an external broad-dimensioned wall of said resonant structure.

6. A resonator as recited in claim 3, wherein said resonant structure is metal and said interaction material is confined between the broad- and narrow-dimensioned walls, a wall of said resonant structure having an opening through which light may pass for illuminating said interaction material.

7. A resonant structure as recited in claim 4, wherein said interaction material comprises semiconductor material.

8. A resonant structure as recited in claim 7, wherein said semiconductor material is of resistivity approximately equal to or greater than ten ohm-centimeters.

9. A resonant structure as recited in claim 7, wherein said light penetrates approximately ten percent or less of said semiconductor material.

10. A resonant structure as recited in claim 8, wherein said semiconductor material is selected from the group consisting of covalently bonded semiconductors.

11. A resonant structure as recited in claim 10, wherein said covalently bonded semiconductors are selected from the group consisting of silicon and germanium.

12. A resonant structure as recited in claim 5, wherein said resonant structure is formed from a dielectric material and said film of interaction material is formed from semiconductor material, the permittivity of the dielectric being approximately equal to the permittivity of the semiconductor.

13. A resonant structure as recited in claim 12, wherein said semiconductor material is of resistivity approximately equal to or greater than ten ohm-centimeters.

14. A resonant structure as recited in claim 12, wherein the thickness of said film of semiconductor material is approximately ten percent or less of the thickness of the narrow-dimensioned wall of said dielectric resonant structure, and said light penetrates the entire thickness of the film of semiconductor material.

15. A resonant structure as recited in claim 13, wherein said semiconductor material is selected from the group consisting of covalently bonded semiconductors.

16. A resonant structure as recited in claim 15, wherein said covalently bonded semiconductors are selected from the group consisting of silicon and germanium.

17. A resonant structure as recited in claim 6, wherein said interaction material is attached to an internal narrow-dimensioned wall of said resonant structure, a narrow-dimensioned wall of said resonant structure being opposite the wall to which said interaction material is attached and having an opening through which light may pass for illuminating said interaction material.

18. A resonant structure as recited in claim 17, wherein said internal narrow-dimensioned wall is the internal wall of large circumference.

19. A resonant structure as recited in claim 6, wherein said interaction material is formed from semiconductor material.

20. A resonant structure as recited in claim 19, wherein said semiconductor material is of resistivity approximately equal to or greater than ten ohm-centimeters.

21. A resonant structure as recited in claim 19, wherein the thickness of said semiconductor material is approximately ten percent or less of the broad-dimensioned wall of said resonant structure and said light penetrates the entire thickness of the semiconductor material.

22. A resonant structure as recited in claim 20, wherein said semiconductor material is selected from the group consisting of covalently bonded semiconductors.

23. A resonant structure as recited in claim 22, wherein said covalently bonded semiconductors are selected from the group consisting of silicon and germanium.

* * * * *